US005825095A

United States Patent [19]

Albecker, III

[11] Patent Number: 5,825,095

[45] Date of Patent: Oct. 20, 1998

[54] LEISURE CHAIR STRUCTURE

[76] Inventor: Walter J. Albecker, III, 838 S. May, Chicago, Ill. 60607

[21] Appl. No.: 403,393

[22] Filed: Mar. 14, 1995

Related U.S. Application Data

[63] Continuation-in-part of Ser. No. 899,750, Jun. 17, 1992, Pat. No. 5,425,567.

[51] Int. Cl.[6] ..... A47C 1/14

[52] U.S. Cl. ..... 297/377; 297/25; 297/35; 297/447.2; 5/419

[58] Field of Search ..... 297/16.1, 21, 25, 297/31, 35, 56, 129, 377, 411.4, 447.2; 5/419, 633; D6/335, 336, 368

[56] References Cited

U.S. PATENT DOCUMENTS

| | | | |
|---|---|---|---|
| 215,579 | 3/1879 | Hehn | D15/8 |
| 1,219,437 | 3/1917 | Butler . | |
| 1,865,030 | 6/1932 | McCauley | 155/154 |
| 2,042,252 | 5/1936 | Freedman | 297/27 X |
| 2,308,410 | 1/1943 | Winter | 155/154 |
| 3,092,224 | 6/1963 | O'Neil | 190/8 |
| 3,189,384 | 6/1965 | Fortier | 297/351 |
| 3,285,654 | 11/1966 | Cramer | 297/35 |
| 3,293,669 | 12/1966 | Emery | 5/327 |
| 3,329,979 | 7/1967 | Drapin | 5/327 |
| 4,065,172 | 12/1977 | Gawlinski | 297/423.4 X |
| 4,410,214 | 10/1983 | Geschwender | 297/118 |
| 5,058,948 | 10/1991 | Singer | 297/18 |
| 5,303,975 | 4/1994 | Asato | 297/56 X |

FOREIGN PATENT DOCUMENTS

| | | | |
|---|---|---|---|
| 1239219 | 7/1960 | France | 297/21 |
| 1284074 | 1/1962 | France | 297/56 |
| 641771 | 7/1962 | Italy . | |

OTHER PUBLICATIONS

Fiesta—from p. 151 of Portable Furniture by Vicki Brooks 1986.

Toshiyuki Kita, "Wink" Chair from p. 218 from 20th Century Furniture Design.

Autti Nurmesniemi from Design From Skandanivia 1977 p. 32.

*Primary Examiner*—Peter R. Brown

[57] ABSTRACT

A number of variations of a simple structure for leisure chairs appropriate for both serious indoor use as well as outdoor use. The structure comprises a backrest or occupant supporting member (2) that intersects with and is attached to a countersupporting member (4) in a manner that results in each bearing on the other. Embodiments are disclosed that include armrests (A.P.) as an integral part of the countersupporting member (4). The backrest member (2) is disclosed as straight, with a convex curve in the lower portion (L.P.) of the backrest member (2) to support an occupant's lumbar curve, with a bend between the upper and lower portion to orient the upper portion (U.P.) of the leisure chair at a higher angle than the lower portion (L.P.). A variety of methods of attaching the backrest member (2) to the countersupporting member (4) are disclosed, as are a number of ways of securing the leisure chair in an open position. Other embodiments are disclosed with a seat and legrest structure (3) attached to the occupant supporting member (2). Also disclosed are a couple of chairs with upholstery (12, 14 and 16) and miscellaneous finishing touches as examples of how the structure might be used in finished chairs.

22 Claims, 12 Drawing Sheets

LEISURE CHAIR STRUCTURE

CROSS REFERENCE TO RELATED APPLICATION

This application is a continuation-in-part of application Ser. No. 07/899,750, filed Jun. 17, 1992, now U.S. Pat. No. 5,425,567, granted Jun. 20, 1995, which application is incorporated by reference herein, in its entirety. Additionally, this invention uses an upholstery system described in my patent application filed on Dec. 23, 1994, now U.S. Pat. No. 5,655,812, granted Aug. 12, 1997.

BACKGROUND

1. Field of Invention

This invention relates to furniture, and spedifically to leisure chairs which enable a user to sit very close to the ground, of the kind which could be ideally used for sitting on while at the beach, on a lawn like at an outdoor concert, or in a home for watching television or reading.

2. Discussion of Prior Art

Over the years, numerous leisure chairs have been developed for enabling people to sit close to the ground. Examples of such chairs include:

U.S. Pat. No. 1,219,437 to Butler which discloses a folding backrest which is very simple in construction and is used for sitting on beaches etc. This chair shows only a straight backrest, does not include any provision for a lumbar support, does not appear to support the upper back and head, and does not include any armrests.

U.S. Pat. No. 4,410,214 to Geshwonder which discloses a leisure chair which can be used for sitting close to the ground, but it does not support the upper back and head, does not have a provision for armrests, and though it can relatively simple in construction and can easily be disassembled for storage, it does not fold up simply.

U.S. Pat. No. 2,308,410 to Winter discloses folding leisure chairs with and without arms. These chairs are somewhat complicated, and as a result of having many components, it looks somewhat "mechanical" as opposed to what one might want for a comfortable chair. The Winter chair with arms has 6 pivoting points, 5 rigid side members on each side and 5 cross members, this compares with only 2 pivoting points, 2 rigid side members on each side and 4 cross members in the present invention. The horizontal base portion of the Winter frame seems to be an adaptation of a pool lounge type chair mechanism in that it is a rigid frame and it has notches and a rear cross member for spacing. Because it has this rigid base frame, the floor area it takes up is larger than the present invention.

A wide variety of beach chairs available through department stores throughout the U.S. that are folding, have more parts than the present invention, and for many people are not especially comfortable for prolonged sitting.

All of the leisure chairs heretofore known suffer from one or more of the following disadvantages:

(a) They are relatively complicated and expensive to manufacture.

(b) They are not foldable.

(c) They are not very comfortable for prolonged sitting.

(d) They are not especially attractive with so many parts.

(e) They do not have armrests.

(f) They do not support the head or upper back of the user.

(g) They are not suitable for use as an interior chair for watching television or reading.

(h) They have basically flat backrests and are not designed to enable the lower back of an occupant to be at a very comfortable really reclined position, while the upper back of the occupant is at a more upright position —which is ideal for watching television or watching an outdoor concert.

OBJECTS AND ADVANTAGES OF INVENTION

Accordingly several objects and advantages of the present invention are:

(a) To provide a structure for a leisure chair that is relatively simple and inexpensive to manufacture.

(b) To provide a structure for a leisure chair that can be foldable.

(c) To provide a structure for a leisure chair that is very comfortable for prolonged sitting.

(d) To provide a leisure chair that will be attractive.

(e) To provide a leisure chair with armrests.

(f) To provide a leisure chair that supports the upper back and head of the user.

(g) To provide a structure that can be suitable for use as an interior chair for watching television or reading.

Further objects and advantages of my invention will become apparent from a consideration of drawings and ensuing descriptions of it.

DESCRIPTION OF INVENTION

Figure 1A:
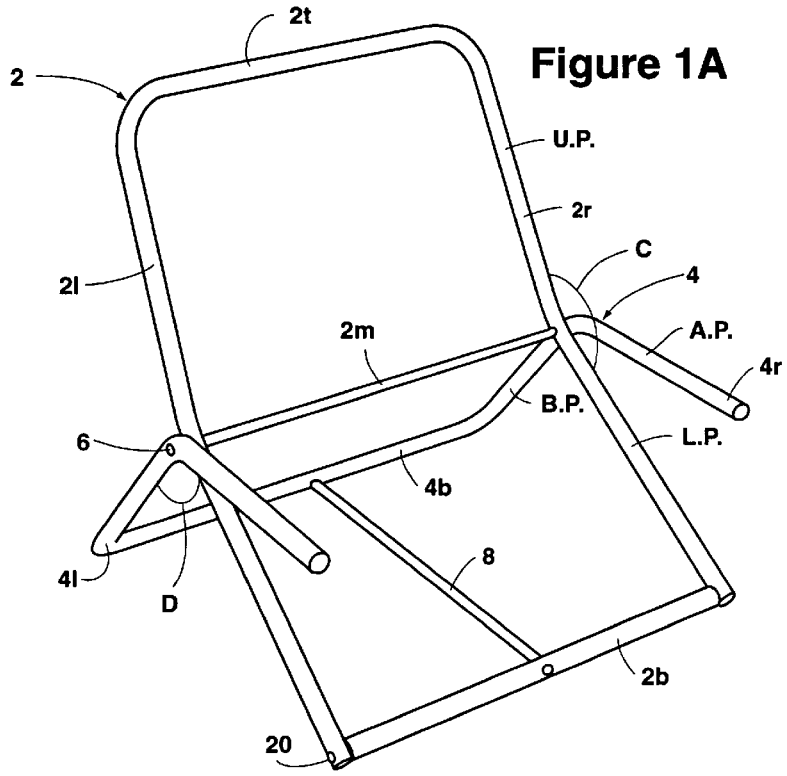
FIG. 1A is an isometric view of a frame of a typical embodiment of the present invention.

FIG. 1A is an isometric view of a frame of a typical embodiment of the present invention. In FIG. 1A the frame is shown made of a material such as tubular aluminum or tubular steel. The diameter shown is about ¾" but can certainly be made with different diameters. In the drawing, the backrest or occupant supporting member 2 has two sides 21 and 2*r*, a top or upper cross member 2*t* and a bottom or lower cross member 2*b*. The lower cross member 2*b* defines the front of the frame. In FIG. 1A the occupant supporting member 2 is shown with two perimeter pieces that together form a generally rectangular shape. The two sides 21 and 2*r* and the top 2*t* are formed out of one piece generally in a U-shape. In a preferred embodiment, the total length of the tube is about 7', and bent at two 90 degree bends in a manner to form the U-shaped piece shown so that the length of the U-shaped piece is about 32" to 36" and the width is about 20" to 22". The lower cross member 2*b* is about 18" to 22" long, and is a separate piece attached to the lowest part of the sides 21 and 2*r*. The currently preferred method of attaching the lower cross member 2*b* to the sides 21 and 2*r* is to put a threaded nylon insert into each of the ends of the lower cross member 2*b*, providing a hole through the tubing on the lowest part of each of the sides 21 and 2*r*, and then putting a screw 20 through the holes and screwing the screw 20 into the nylon insert in the ends of the bottom cross member 2*b*. Additionally it might be preferable to finish the open ends of the bottoms of the sides 21 and 2*r* by rounding the ends or by putting a cap or plug on or into the ends of the tubing. Another way of joining the U-shaped frame 2 to the lower cross member 2*b* would be with elbows that could be made out of a plastic material and be similar in appearance, and that use the same principles as the type of elbows having two male ends that are used to join hoses together for conveying air or liquids. Such elbows are readily available at well stocked hardware stores, or plumbing and heating suppliers. Note that the elbows commercially available may not have adequate strength to support the joint under repeated stress, but can clearly illustrate to someone skilled in the art how the joint can be made.

The occupant supporting member 2 is shown with a bend or an obtuse angle C of about 160 to 170 degrees in each of the sides 21 and 2*r*. The angle is located about half way up each of the sides about 16 to 18 inches from the bottom ends of each of the sides 21 and 2*r*.

The occupant supporting member 2 also is shown with an optional middle cross member 2*m* mounted between the two sides 21 and 2*r* of the occupant supporting member generally near the point where the interconnecting pivot 6 is located. This cross member can be used for maintaining uniform spacing between the side members 21 and 2*r* and also it can be used for holding a support sheet in place near the position of the middle cross member 2*m*. The middle cross member 2*m* can be made of tubular metal similar to that used for the perimeter pieces 2*b* and 21, 2*t* and 2*r*. The middle cross member 2*m* can also be made of other materials such as a metal rod which could extend through the sides 21 and 2*r* of the occupant supporting member, as well as possibly extending through the sides 41 and 4*r* of the counter supporting and armrest member 4 to and then be riveted, capped, or secured in another suitable manner that would be known to those skilled in the art relating to this invention. In this manner, the middle cross member 2*m* could then act as part of the pivoting pin 6 as described below.

Figure 3:
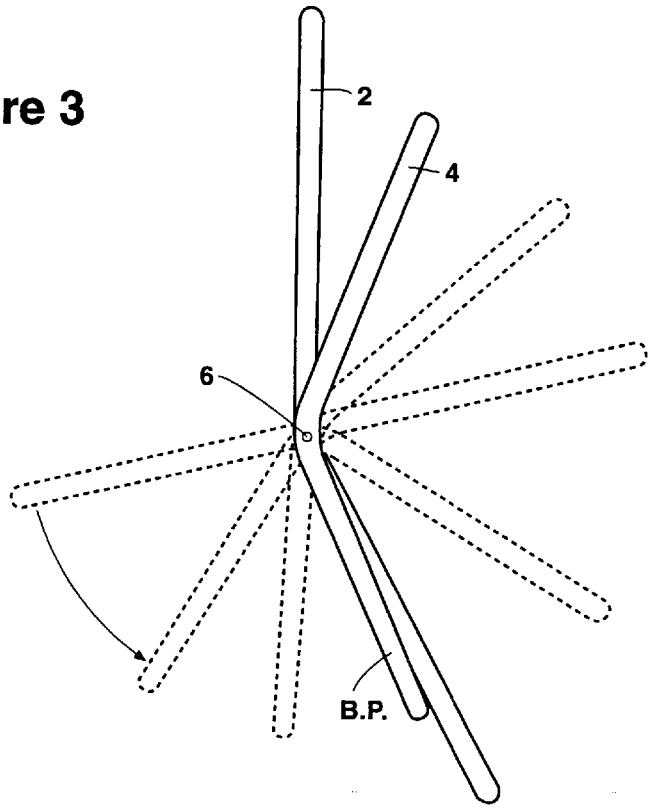
FIG. 3 is a side view of the frame shown in FIGS. 1 and 2, but shown in the folded position.

In the drawing, the occupant supporting member 2 is interconnected with the countersupporting member 4 on each side of the occupant supporting member 2 at the points of intersection between the occupant supporting member 2 and the countersupporting member 4 with an attachment means such as a pivoting pin or rivet 6. Between the occupant supporting member 2 and the countersupporting member 4 at the position of the pivoting pin 6 it might be advisable to use either a washer, bushing or other suitable spacer to make it easier to fold the frame as shown in FIG. 3 without having the sides of the occupant supporting member 2 rub with the sides of the countersupporting member 4.

The countersupporting member 4 has two sides 4*r* and 41 and a base 4*b*. The two sides 41 and 4*r* and the base 4*b* are formed out of one piece generally in a U-shape. In a preferred embodiment, the total length of the tube is about 5 ½', and it is bent at two 90 degree bends in a manner to form the U-shaped piece 4 shown so that the length of each of the sides 41 and 4*r* of the U-shaped piece is about 26" to 28", and the width of the base 4*b* is about 21" to 23". Additionally, the countersupporting member 4 is shown with an obtuse angle D of about 130 to 140 degrees in each of the sides 41 and 4*r*. The angle is located about half way up each of the sides 41 and 4*r* when measured from the base 4*b*. In a preferred embodiment, the measurement from the of the base portion B.P. of the countersupporting member 4 measured from the base 4*b* to the obtuse angle bend D is about 12 to 14 inches. The armrest portion A.P. of the of the sides 4*r* and 41 is close to parallel with a horizontal plane and is obviously for armrests. It is certainly possible to make a workable embodiment of my invention using significantly different measurements and angles, especially for users of different heights, or for more than one occupant such as a love seat.

The lower cross member 2*b* of the occupant supporting member 2 is interconnected with the base portion 4*b* of the countersupporting member 4 with a position securing chord 8 to prevent the occupant supporting member 2 from collapsing when weight is put on it. In a preferred embodiment, there is one chord made of nylon that is about ¼" in diameter. Though only one securing chord 8 is shown, there is no reason why more than one horizontal securing chords 8 could not be used. Though the open position securing member 8 is shown as a chord, it can easily be made with a belts, cables, straps, rods, wires, bars, tubes, chains, ropes, webbing, etc.

Figure 1B:
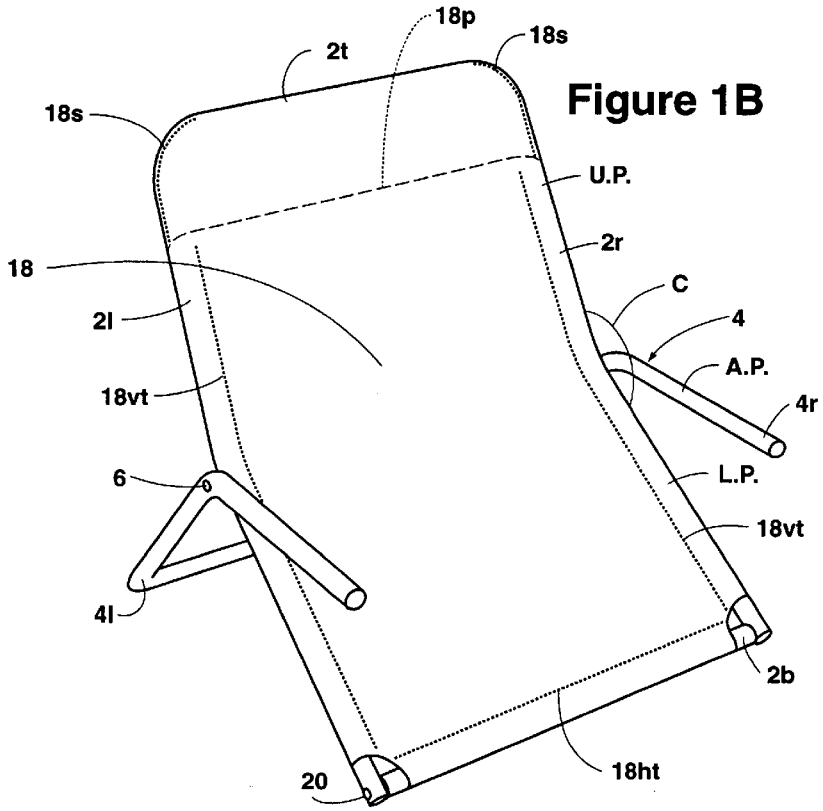
FIG. 1B is an isometric view of the frame shown in FIG. 1A, but with a support sheet secured to the sides, to the top and to the bottom of the frame.

FIG. 1B is an isometric view of the frame shown in FIG. 1A, but with a support sheet 18 on the frame. This figure illustrates how the most preferred embodiments of this invention can have a complete support structure consisting of only four elements: 1) the generally rectangular occupant supporting member 2 (which includes the lower cross member 2*b* and can include the middle cross member 2*m* shown in FIG. 1A); 2) the support sheet 18 on the occupant supporting member frame; 3) the generally U-shaped countersupporting member 4; and 4) at least one interconnection means between the occupant supporting member 2 and the countersupporting member 4 such as a pivoting pin 6 on both the left side and right side of the leisure chair and in some instances at least one additional interconnecting element below the interconnection means 6 to hold the structure in position as shown such as the position securing member 8 shown in FIG. 1A.

Figure 7:
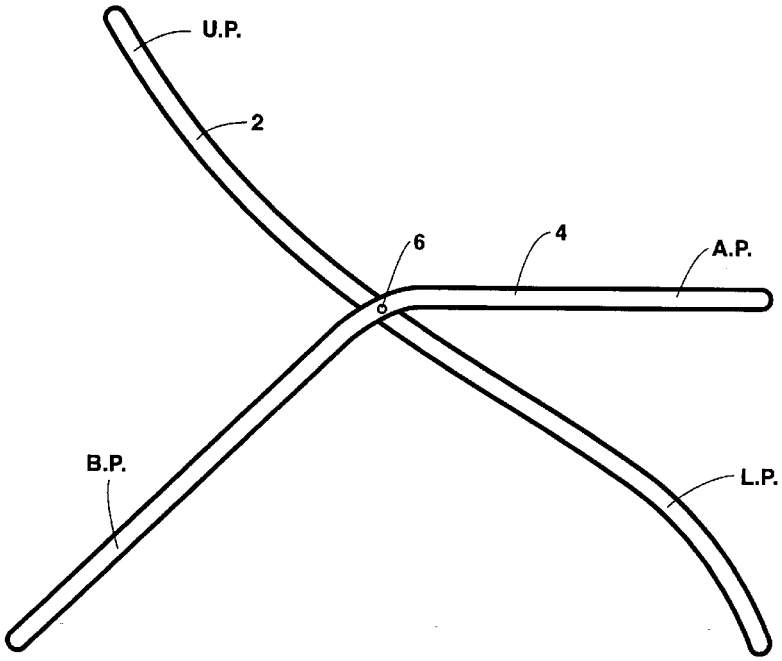
FIG. 7 is a side view of a typical embodiment of the present invention showing the occupant supporting member contoured to provide a lumbar support and to follow other natural contours of the human back.
Figure 8:
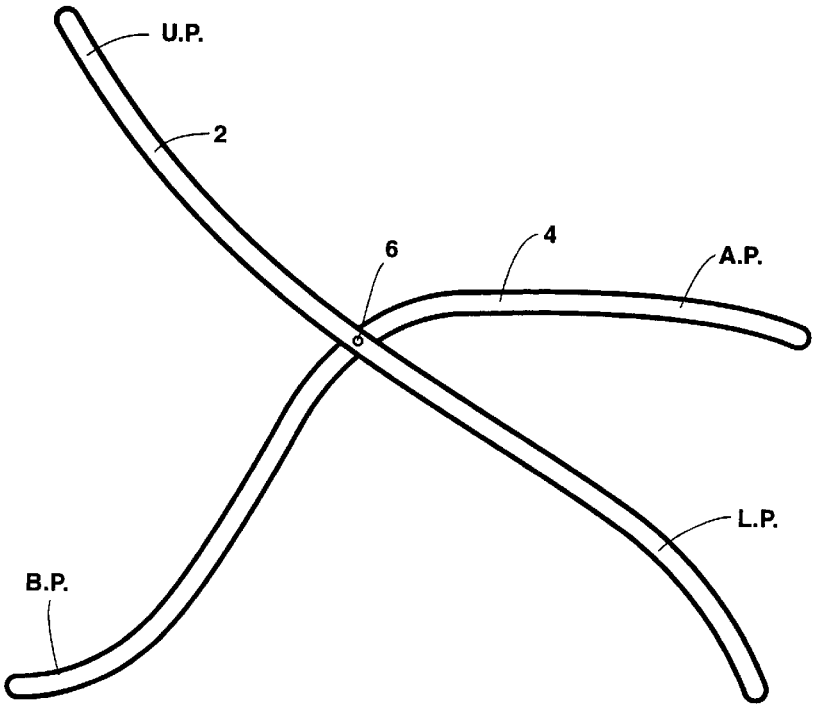
FIG. 8 is a side view of a typical embodiment of the present invention showing both the occupant supporting member and the countersupporting member with contours.
Figure 12:
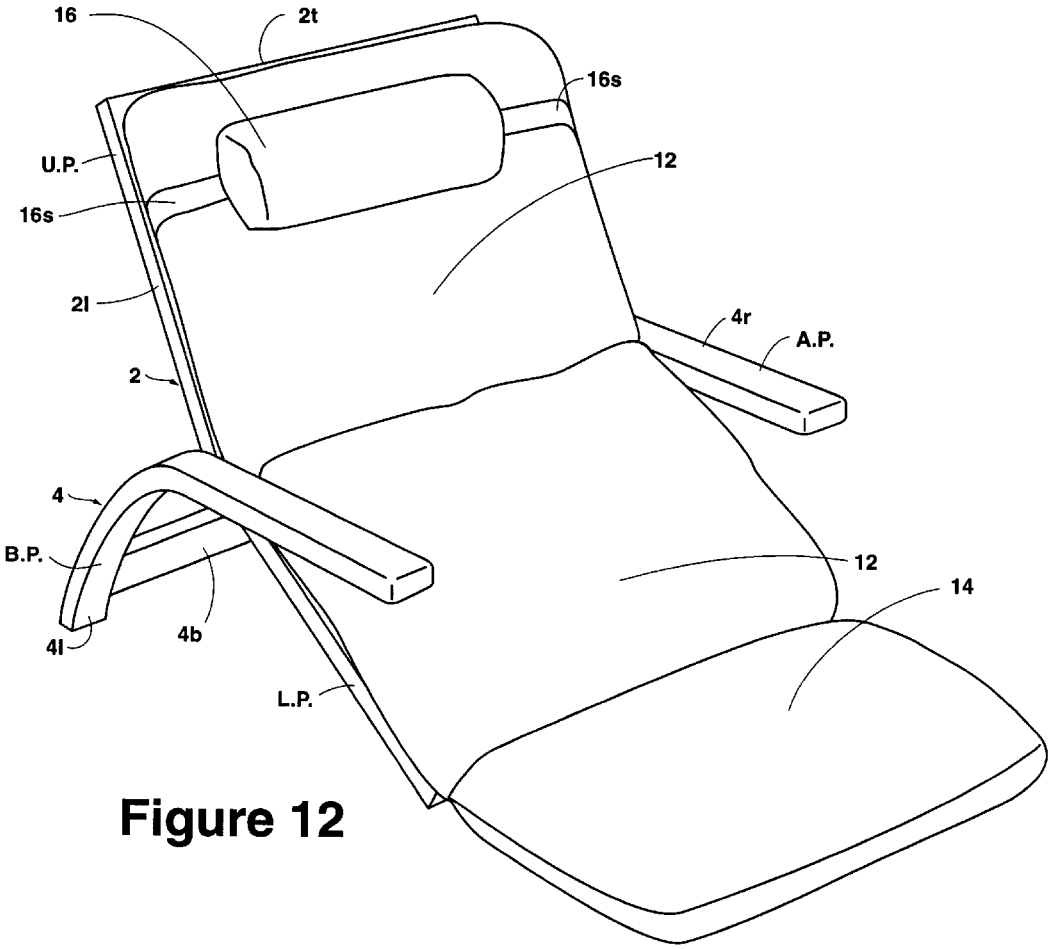
FIG. 12 is an isometric view of a frame similar to those shown in FIGS. 1, 2, 3, and 10 shown upholstered in a typical fashion with cushions and other upholstery elements in a manner that might be suitable for a more formal leisure chair.
Figure 13:
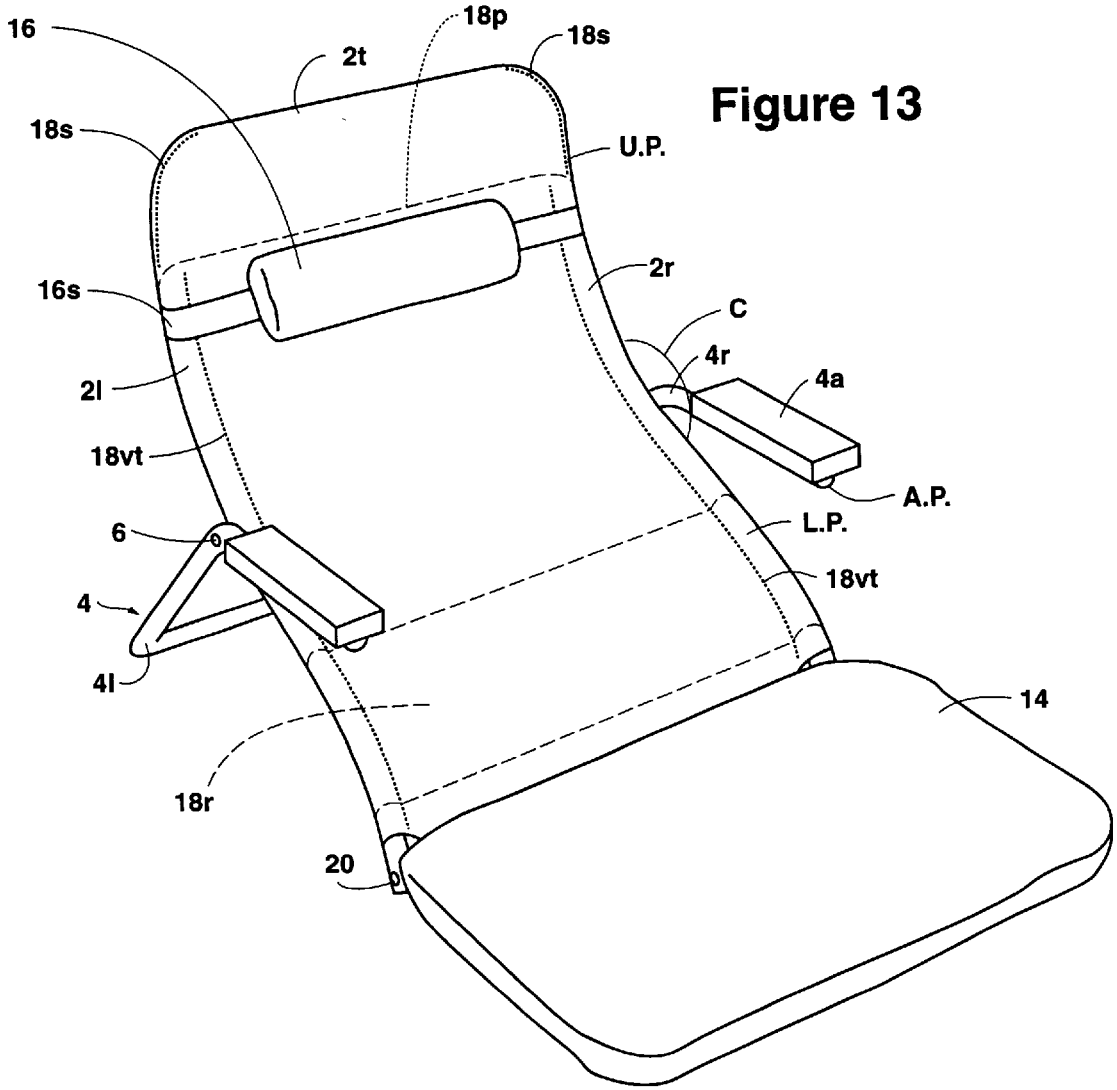
FIG. 13 is an isometric view of a typical embodiment using a frame similar to the ones shown in FIGS. 1, 2, and 3 but shown as it might be upholstered with a seat cushion and head pillow. This type of chair might be ideal for casual or outdoor use.

As shown, the support sheet 18 is made of a fabric such as a canvas, and is secured to the backrest frame by having the sides of the fabric sewn into tubes 18vt suitable for having the sides of the occupant supporting member 21 and 2*r* slipped into the tubes 18vt. This enables the support sheet 18 to be stretched between the sides of the backrest frame member 21 and 2*r* as shown. Also, the support sheet 18 is shown with a tube 18ht sewn in it across the bottom to secure the support sheet 18 to the bottom cross member 2*b*. Also there is a pocket of sorts 18*p* sewn into the top of the support sheet 18 to secure it to the top 2*t* of the backrest frame. The pocket 18*p* would not be seen from this view, but is shown with a phantom line to clarify what is meant. It is also quite possible to make a support sheet with a type of construction generally similar to a pillowcase that would be pulled completely over the occupant supporting member 2. These methods should be easily understood by people skilled in making casual furniture such as hammocks and leisure chairs with canvas seats and backs. The type of support sheet 18 shown for FIG. 1B is particularly well suited for use on some of the contoured occupant supporting members such as shown in FIGS. 7 and 8. It should also be noted that seat cushions 14 such as shown in FIGS. 12 and 13 can be attached directly to the support sheet 18, by sewing straps, or an appropriate upholstery part of the seat cushion directly to the support sheet 18 at about the same place that the horizontal tube 18ht is sewn across the bottom of the support sheet 18.

Figure 1C:
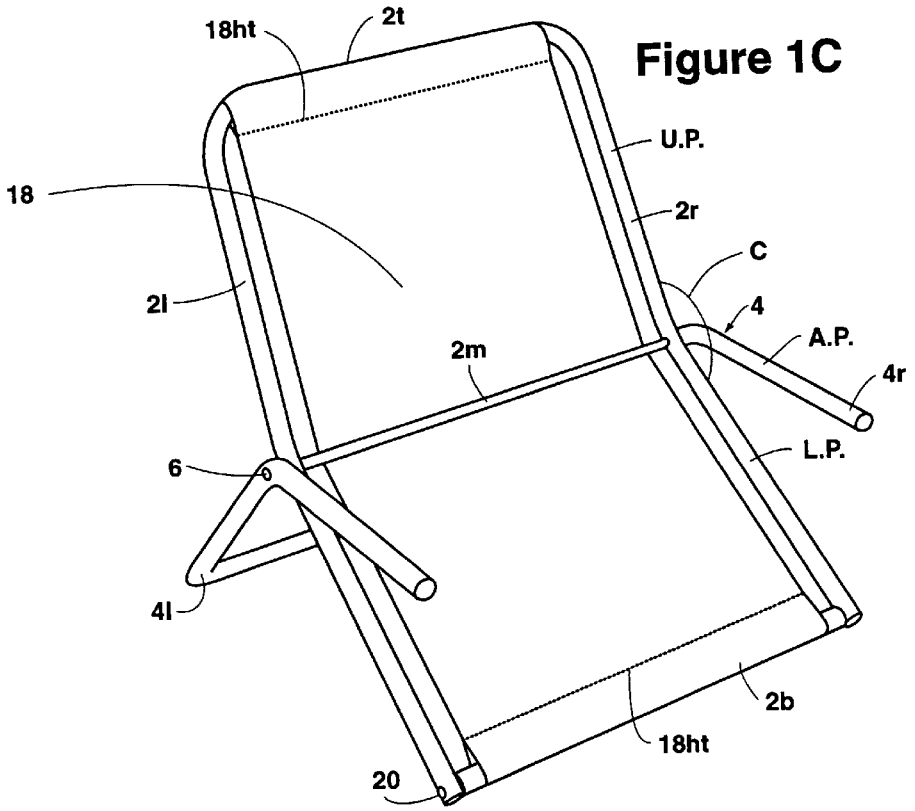
FIG. 1C is an isometric view of the frame shown in FIG. 1A, but with a support sheet similar to the one in FIG. 1B, except it is not secured to the sides of the backrest frame.

FIG. 1C is an isometric view of the frame shown in FIG. 1A with a support sheet 18 similar to the one shown in FIG. 1B, but instead of being secured to the sides of the frame 21 and 2*r*, this support sheet 18 is primarily secured to the cross members 2*b*, 2*m*, and 2*t*. This can be done with tubes 18ht sewn to the top and bottom of the support sheet 18, or by stapling the top and bottom of the support sheet 18 to the cross members if the cross members 2*b* and 2*t* were made of wood or another material suitable for stapling to. The middle cross member 2*m* is shown on top of the support sheet 18 to hold the support sheet 18 in the proper position. It is also possible to have the middle cross member 2*m* made of two parallel pieces, one on top of the support sheet 18, and one below the support sheet 18, in this case, the cross member below the support sheet 18 might be attached to the sides 21 and 2*r* of the backrest frame, while the cross member above the support sheet 18 would be attached to the cross member below with screws or another suitable attachment means. As described in my patent application Ser. No. 08/363,753, upholstery and a cushion can certainly be attached to the support sheet 18, or upholstered cushions can simply be placed on top of the support sheet 18 and suitably attached. Though the support sheet 18 is shown made of a fabric such as canvas, it is certainly possible to make a support sheet of many other materials such as but not limited to webbing, a plurality of slats, springs, wires, a sheet of fabric, wood, plywood, molded resin, and other products or materials that can form a generally flat support structure or support sheet capable of supporting the weight of a human occupant. Additionally, there are other methods of securing fabric support sheets to a frame that are known to people skilled in the art of upholstery.

Figure 1D:
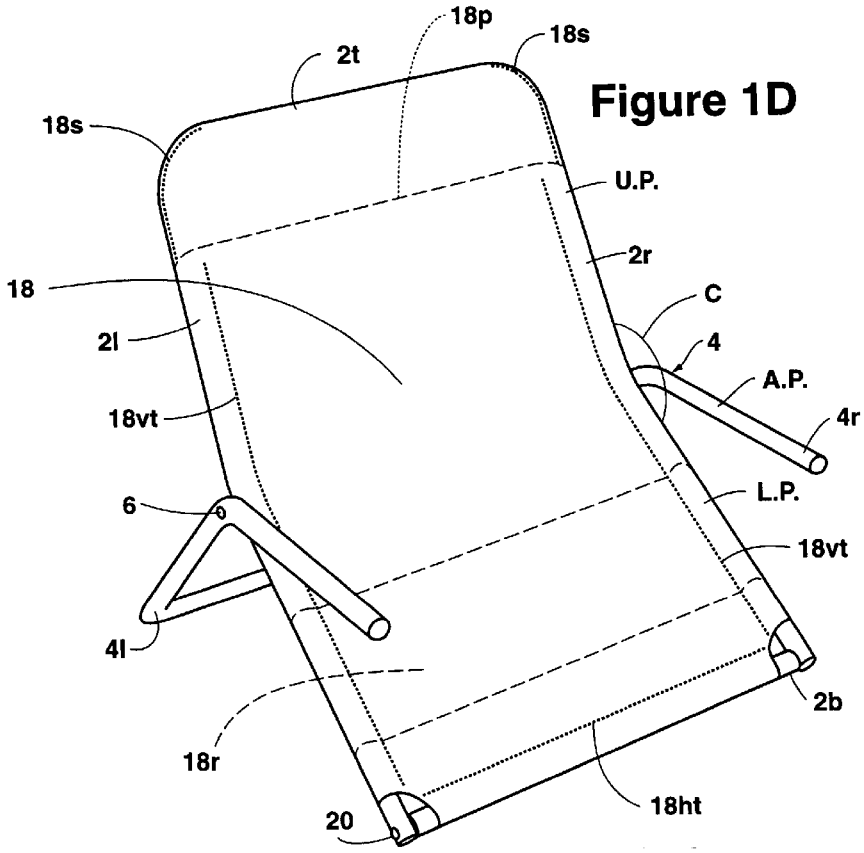
FIG. 1D is an isometric view of the structure shown in FIG. 1B or 1C, but shown with special reinforcing on the lower portion of the backrest structure for providing greater support to a user's lumbar region.

FIG. 1D is an isometric view of the structure shown in FIG. 1B but shown with special reinforcing 18*r* on the lower portion of the backrest frame for providing greater support to a user's lumbar region to help maintain the user's spine in a relatively natural lordotic curve. The reason this reinforcing may be desired is that gravity has a natural tendency to flatten out a reclining occupant's lumbar curve, and this tendency is likely to put additional stress in the area on the support sheet 18 of the occupant supporting member 2 that would be right beneath an occupant's lumbar curve. The lumbar reinforcing 18*r* is an optional enhancement and can be made of webbing, elastic webbing, canvas, cloth, fabric, flexible plastic, vinyl, belts, straps, strings, and other thin relatively thin flat flexible materials. There can be one strip of reinforcing, or a number of strips either on top of one another or side by side, depending on the width and particular feel that is sought. There are a number of ways of doing this, but the basic principle is to provide a reinforcing additional material to be stretched between the sides 21 and 2*r* of the occupant supporting member 2 at a position to correspond with the lumbar region of an occupant's back. The reinforcement 18*r* can be attached to the sides of the support sheet 18 when the vertical tubes 18vt are sewn by putting the reinforcement 18*r* on the support sheet 18 before the vertical tubes 18*t* are sewn in place as in the manner shown with the phantom lines just indicating the position of the reinforcement 18*r* underneath the support sheet 18, it can be sewn onto the support sheet to directly reinforce the support sheet with the stitching joining the reinforcing 18*r* to the support sheet approximately following the phantom lines shown outlining the reinforcement 18*r*, or in the case of a support sheet such as is shown in FIG. 1C, the reinforcement 18*r* can be directly secured to the sides 21 and 2*r* of the occupant supporting member by putting vertical tubes in the reinforcing material itself similar to the vertical tubes 18vt. In the case of an occupant supporting member made of wood or a similar material, the reinforcing material can be stapled to the sides 21 and 2*r*. And while it is may be preferable to put this reinforcement 18*r* beneath the support sheet 18, it is certainly possible to put it on top of the support sheet 18.

Figure 2:
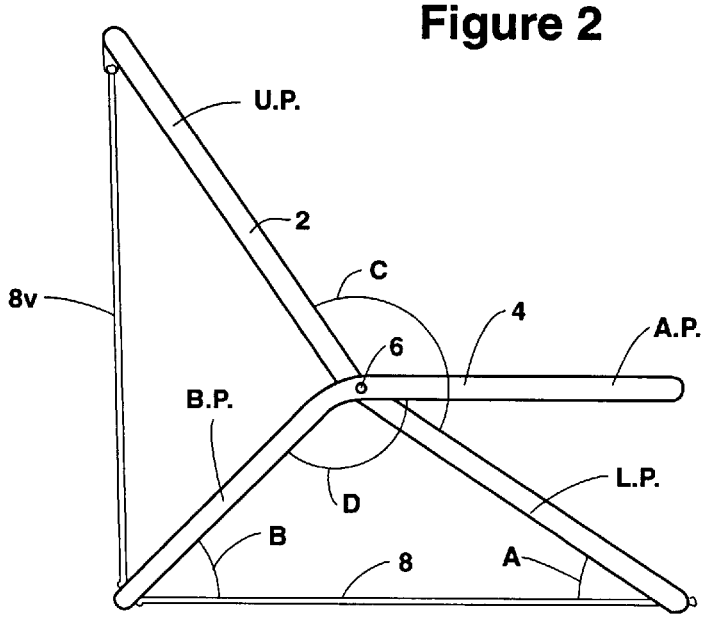
FIG. 2 is a side view of the frame shown in FIG. 1.

FIG. 2 is a side view of the frame shown in FIG. 1A. In the drawing, the occupant supporting member 2 is shown oriented to form an acute angle A with a horizontal plane such as a floor or ground, and it is shown with a lower portion L.P. and an upper portion U.P. In a preferred embodiment the acute angle A is between about 40 and 50 degrees, but the frame can be made with a structure that has an acute angle A that ranges from about 20 degrees to about 80 degrees. The division between the upper portion U.P. and the lower portion L.P. is near the point where the countersupporting member 4 intersects with the occupant supporting member 2 and is attached with a pivoting pin 6. The countersupporting member 4 is shown with a base portion B.P. and an armrest portion A.P. which is divided near the point where the occupant supporting member 2 is attached with the pivoting pin 6. The upper portion U.P. of the occupant supporting member 2 shown in FIG. 2 is at a higher angle than the lower portion L.P. In a preferred embodiment, the difference in angle is between about 10 degrees and about 20 degrees. This is accomplished through having bend or an obtuse angle C of between about 160 degrees to 170 degrees on the occupant supporting member 2. The purpose of this angle C is to enable the user to have his or her lower back in a really comfortable reclining position, but at the same time his or her upper back can be ideally oriented for watching something such as an outdoor concert when the chair is situated on a lawn or the like. On the countersupporting member 4, the armrest portion A.P. is shown approximately parallel to a horizontal plane such as a floor or ground, with the base portion B.P. being oriented to form an acute angle B (which is opposite angle A) of about 40 to 50 degrees with the horizontal plane in such a manner that the base portion B.P. on the countersupporting member 4 is angled to intersect with the occupant supporting member at approximately the location of the pivoting pin 6. The obtuse angle D formed between the base portion B.P. and the armrest portion A.P. is between about 130 and 140 degrees. The reader will note that the sides of the countersupporting member 4 are integral and continuous between the armrest portion A.P. and the base portion B.P. The reader will also note that a triangle is formed with the base portion B.P., the lower portion L.P., and the position securing chord 8 or a horizontal plane such as a floor.

The position fixing chord 8 can be mounted from the bottom 2*b* (all cross members for FIG. 2 are as shown on FIG. 1A) of the occupant supporting member 2 to the base 4*b* of the countersupporting member 4. The vertical position fixing chord 8*v* is an optional element that can be used as a supplemental securing mechanism as shown in FIG. 2, being attached from the base 4*b* of the countersupporting member 4 to the top 2*t* of occupant supporting member 2. If the vertical position fixing chord 8*v* was a rigid rod or the like, it could be used in place of the position fixing chord 8. Also, there can be one position fixing chord 8 and/or the vertical position fixing chord 8*v* or there can be more than one of each of them. For example, instead of one position fixing chord 8 centered as shown in FIG. 1A, there could be two (with each positioned a bit away from the center) or more. It is quite possible and possibly preferable for some applications to make the knot on the front end of the position securing chord 8 inside the tube of the lower cross member 2*b* instead of sticking out as shown. This can be accomplished by drilling only one hole through the tube, feeding the chord 8 through the hole and out one end of the tube 2*b*, tying a knot at the end of the chord that has been threaded through the tube, and then pulling the chord back through the hole. Of course it may be preferable to do this after putting the support sheet shown in FIG. 1B around the tube. The reader will note that the occupant supporting member 2 and the countersupporting member 4 will bear directly on the ground or floor without any need for any rigid support structure beneath them.

FIG. 3 is a side view of the frame shown in FIGS. 1 and 2, but shown in the folded position. In the drawing the elements are the same as shown in FIGS. 1 and 2, but the base portion B.P. of the countersupporting member 4 has been moved toward the lower portion L.P. of the occupant supporting member 2 for storage, traveling, or shipping. It should be obvious that in FIG. 2 if the base portion B.P. of the countersupporting member 4 were extended, the angle between the base portion B.P. and the armrest portion A.P. could be straightened out somewhat and still achieve the same angle for the occupant supporting member relative to the horizontal plane. By doing this, it would be possible for the two frame members 2 and 4 shown in FIG. 3 to be nearly parallel, and therefore more compact. Unfortunately, this would result in a chair that when used in the open position as shown in FIG. 2 would not be as compact. This is an example of the kind of tradeoffs that can be made in modifying the frame to make it more compact when folded. The position fixing chord 8 is not shown in FIG. 3, but it could be used in such a way as to hold frame members 2 and 4 in the folded position, and it might also be used to secure any seat cushions or the like that might be added to the frame. In the folded position as shown in this figure, the frame could be stacked with other similar frames for storage or carrying.

Figure 4A:
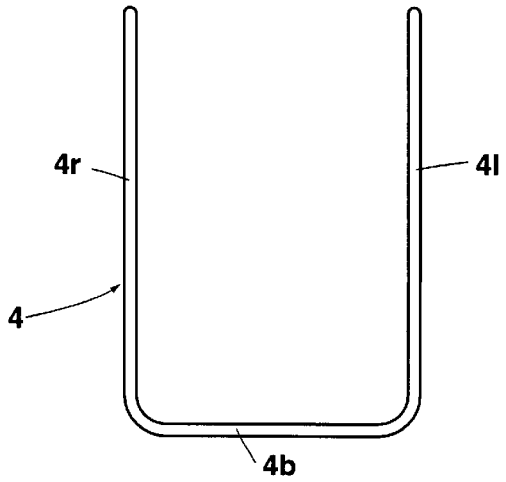
FIG. 4A is a top view of the typical countersupporting member of the frame in a generally U-shape.

FIG. 4A is a top view of the countersupporting member 4 shown in FIGS. 1, 2 and 3. In the drawing, 41 is the left side, 4*r* is the right side, and 4*b* is the base portion. Note that the sides 41 and 4*r* seem to be reversed from the way it is shown in FIG. 1A, this is because it is shown with the base member shown at the lower part of the drawing on FIG. 5, while 4*b* is shown at top of the drawing in FIG. 1A. The frame portion shown in FIG. 4A is in a generally U-shape.

Note: The side profile of this and all the following countersupporting members below can be formed in any of the shapes shown in FIGS. 1, 2, 3, 6, 7, 8, 9, 10, 11, 12, 13, 14, or 15.

Figure 4B:
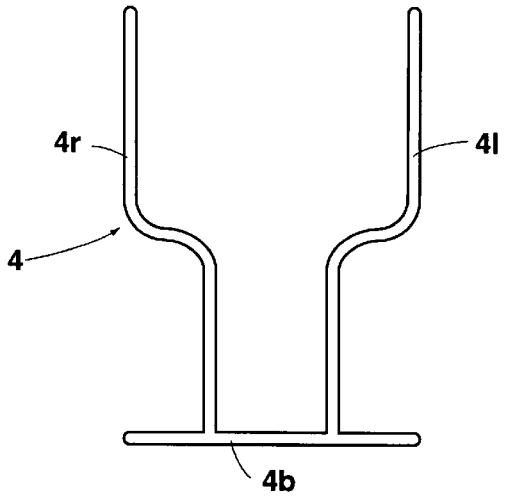
FIG. 4B is a top view of an alternate countersupporting member changed for aesthetic reasons.

FIG. 4B is a top view of an alternate countersupporting member 4 similar to the one shown in FIG. 4A, but with the base 4*b* and the sides 41 and 4*r* changed for aesthetic reasons. This frame could be made of tubular steel, and could be welded at the points where the sides 4*r* and 41 meet the base 4*b*. This frame though different from above, can still be considered a generally U-shape.

Figure 4C:
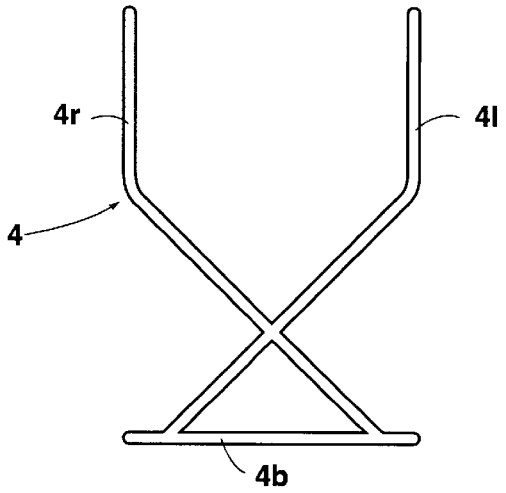
FIG. 4C is a top view of another alternate countersupporting member showing a generally X shape.

FIG. 4C is a top view of another alternate countersupporting member showing a generally X shape. This is another design that might be selected for aesthetic reasons. Similar to the construction in FIG. 4B above, this countersupporting member can be made of tubular steel that is welded at the points where the sides 41 and 4*r* intersect, and also where they contact the base 4*b*.

Figure 5A:
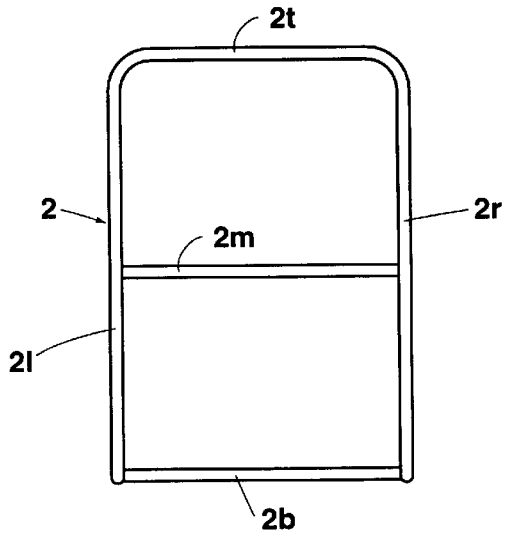
FIG. 5A,is a top view of the typical occupant supporting member of the frame in a generally U-shape including bottom and middle cross portions.

FIG. 5A is a top view of the occupant supporting member 2 shown in FIGS. 1, 2, and 3. The occupant supporting member 2 is shown with 3 basic parts, one part is a generally U-shaped portion having a top 2*t*, two sides 21 and 2*r*, the second part is the bottom 2*b* which is attached to sides 21 and 2*r* near their lowest part, and the third part is a middle spacer 2*m* which provides extra support to the sides or can be used to secure a support sheet to. Note that this middle piece 2*m* is optional and may not be needed for applications where the support sheet is stretched between the sides 21 and 2*r* and where the strength of the sides is so great that the sides will not bend in. On other applications, the middle cross member 2*m* is necessary. As mentioned previously, the occupant supporting member 2 including the generally U-shaped portion 21, 2*r* and 2*t*, when combined with the bottom cross member 2*t* form a generally rectangular shape. It should be noted that the top 2*t* can also be made completely curved to be very much like an upside down U-shape for aesthetic reasons.

Note: The side profile of this and all the following occupant supporting members below can be formed in any of the shapes shown in FIGS. 1, 2, 3, 6, 7, 8, 9, 10, 11, 12, 13, 14, or 15.

Figure 5B:
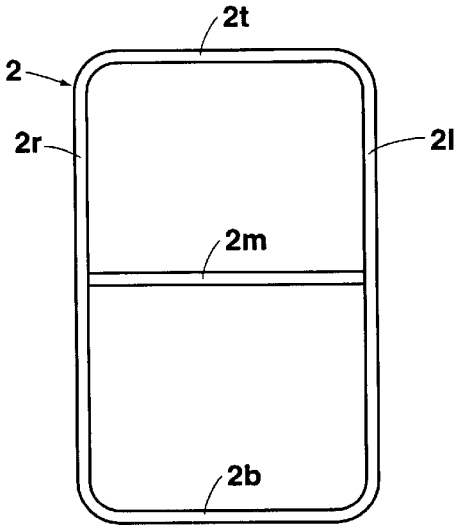
FIG. 5B is a top view of an alternative occupant supporting member that is rectangular.

FIG. 5B is a top view of an alternative occupant supporting member 2 that is rectangular. This rectangular frame can be made out of one piece of material such as tubular steel that is bent into a generally rectangular shape, and the ends can be swaged and fitted at a point where they meet. The rectangular frame can also be made of four pieces, a top 2*t* attached to two sides 21 and 2*r* which are attached to the bottom 2*b*. This can be done either by welding metal or another material together, or by attaching wood or bent wood material with screws and/glue or another joinery method. Also shown is a middle cross member 2*m* which is optional for some upholstery applications, and required on others.

Figure 5C:
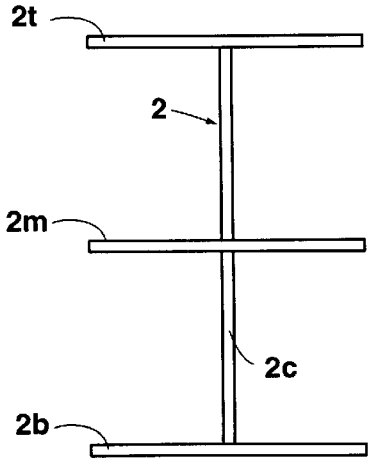
FIG. 5C is a top view of an alternative occupant supporting member using an "I" frame.

FIG. 5C is a top view of an alternative occupant supporting member 2 using an "I" frame. In the drawing, there is a lengthwise member 2*c* that has three cross members 2*t*, 2*m*, and 2*b* connected in a perpendicular manner. The lengthwise member 2*c* is used in place of the two sides 21 and 2*r* shown in FIG. 5A. This "I" frame can be made of tubular steel, with the top cross member 2*t* welded to the top of the lengthwise member 2*c* to form a "T". The middle cross member 2*m* would be welded to 2*c* as shown, and the bottom cross member 2*b* would be welded as shown in a manner like an upside down "T". The cross member 2*m* would interconnect with a countersupporting member such as those shown in FIGS. 4A, 4B, and 4C. When a support sheet is placed over this frame, the occupant supporting member 2 with the support sheet would be in a generally rectangular shape.

Figure 5D:
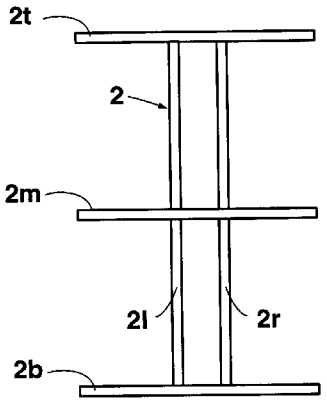
FIG. 5D is a top view of an alternative occupant supporting member similar to the "I" frame shown in FIG. 5C, but using more than one lengthwise support member.

FIG. 5D is a top view of an alternative occupant supporting member similar to the "I" frame shown in FIG. 5C, but using more than one lengthwise support member. In the drawing there are two lengthwise members 21 and 2*r*. All other elements are basically the same. Of course there could be more than two lengthwise pieces.

Figure 5E:
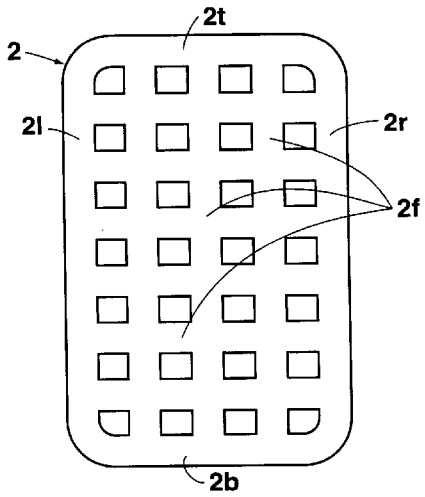
FIG. 5E is a top view of an alternative occupant supporting member with the support sheet elements as part of the frame.

FIG. 5E is a top view of an alternative occupant supporting member with filling supporting elements as part of the frame. This could be made out of something like resin or plastic where both the perimeter elements 2*t*, 2*b*, 21 and 2*r* and the filling supporting elements are molded together. Of course people skilled in the art related to this invention would know other materials and methods to make such a frame. Though the frame shown in FIG. 5E shows the support filler 2*f* in a cross pattern—with both horizontal and vertical fillers 2*f*, it should be obvious to one skilled in the art that the filler 2*f* could also be either only horizontal or only vertical if desired—or in a totally different pattern.

Figure 5F:
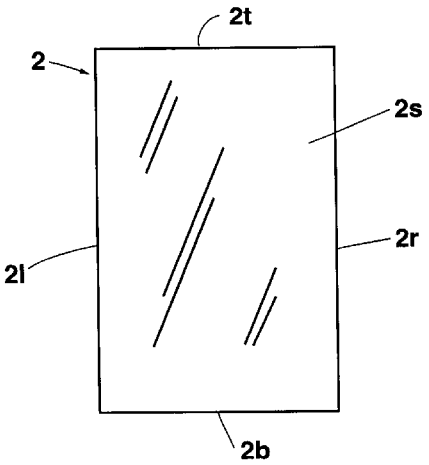
FIG. 5F is a top view of an alternative occupant supporting member which is generally solid, as opposed to open.

FIG. 5F is a top view of an alternative occupant supporting member 2 which is generally solid, as opposed to open. This could be made of molded plywood, or another type of solid sheet material such as plastic, fiberglass, etc. In the drawing, the occupant supporting member 2 has a top cross portion 2*t*, a bottom cross portion 2*b*, side portions 21 and 2*r*, and a solid filler 2*s*. All of these elements can be made integral and continuous, or put together from pieces in a manner similar to a raised panel cabinet door.

Figure 5G:
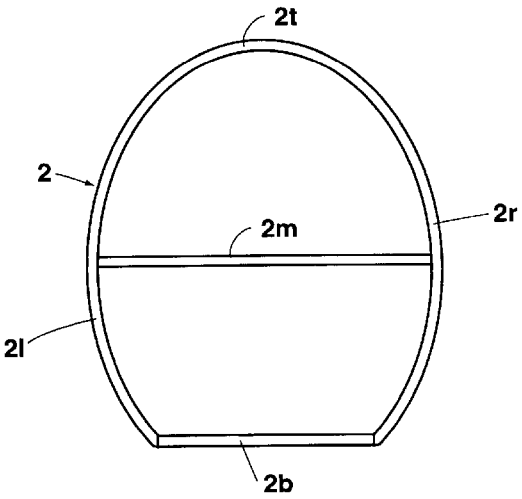
FIG. 5G is a top view of an alternative occupant supporting member where the sides and top have been curved for aesthetic reasons.

FIG. 5G is a top view of an alternative occupant supporting member 2 which has curved sides 21 and 2*r* and top 2*t* altered for aesthetic reasons. This is made in a manner similar to the frame shown in FIG. 5A but with a curved top 2*t* and curved sides 21 and 2*r*. The occupant supporting member 2 can be shaped to be more oval than rectangular as was shown in other figures by curving the sides 21 and 2*r* and the top 2*t*, or for another look, just the top 2*t* can be curved to form something like a circle segment or a semicircle. This figure suggests how any of the above frame structures can be altered for cosmetic reasons.

Figure 6:
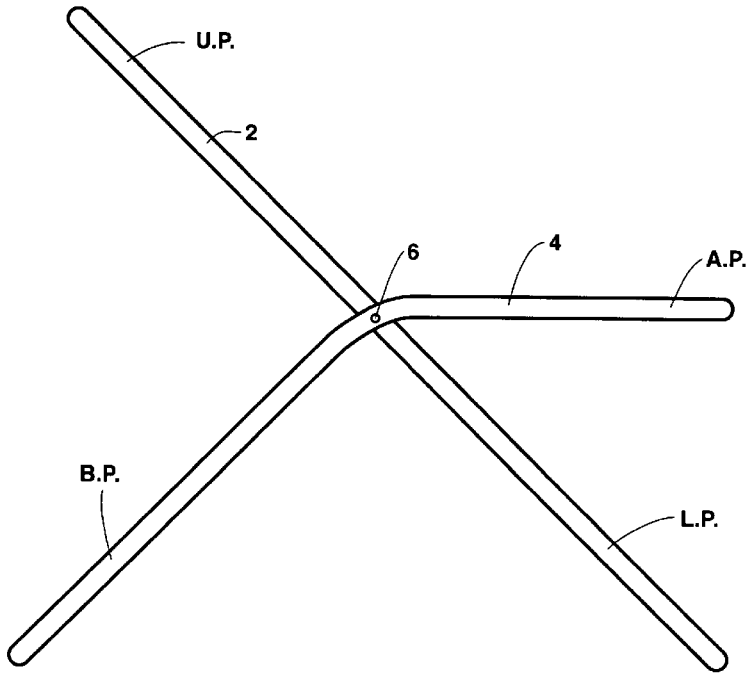
FIG. 6 is a side view of a typical embodiment of the present invention showing the occupant supporting member generally straight.

FIG. 6 is a side view of a typical embodiment of the present invention showing the occupant supporting member 2 generally straight. This chair frame would be made in a manner similar to the one shown in FIG. 1A, except instead of there being a bend or obtuse angle C between the upper portion U.P. and lower portion L.P. of the occupant supporting member 2, the occupant supporting member 2 is generally straight. The countersupporting member 4 is generally similar to the one shown in FIG. 1A. This chair frame using the side profile shown in FIG. 6 can be used with the all of the occupant supporting members in FIGS. 5A through 5G, and the countersupporting members shown in FIGS. 4A through 4C.

FIG. 7 is a side view of a typical embodiment of the present invention showing the occupant supporting member 2 contoured to provide a lumbar support and to follow other natural contours of the human back. This chair frame would be made in a manner similar to the one shown in FIG. 1A, except instead of there being a bend c between the upper portion U.P. and lower portion L.P. of the occupant supporting member 2, the occupant supporting member 2 is made with a number of curves in almost an "S" shape. There is a lower curve for supporting the lumbar region of an occupant in a relatively natural lordotic curve and a middle range curve designed to correspond to the user's thoracic curve. As a result, the average angle relative to a horizontal plane of the upper portion U.P. is higher than the average angle of the lower portion L.P. The countersupporting member 4 is generally similar to the one shown in FIG. 1A. This chair frame using the side profile shown in FIG. 6 can be used with the all of the occupant supporting members in FIGS. 5A through 5G, and the countersupporting members shown in FIGS. 4A through 4C.

FIG. 8 is a side view of a typical embodiment of the present invention showing both the occupant supporting member 2 and the countersupporting member 4 with contours. From previous descriptions, it should be obvious to someone skilled in the art how to make such a chair frame.

Figure 9:
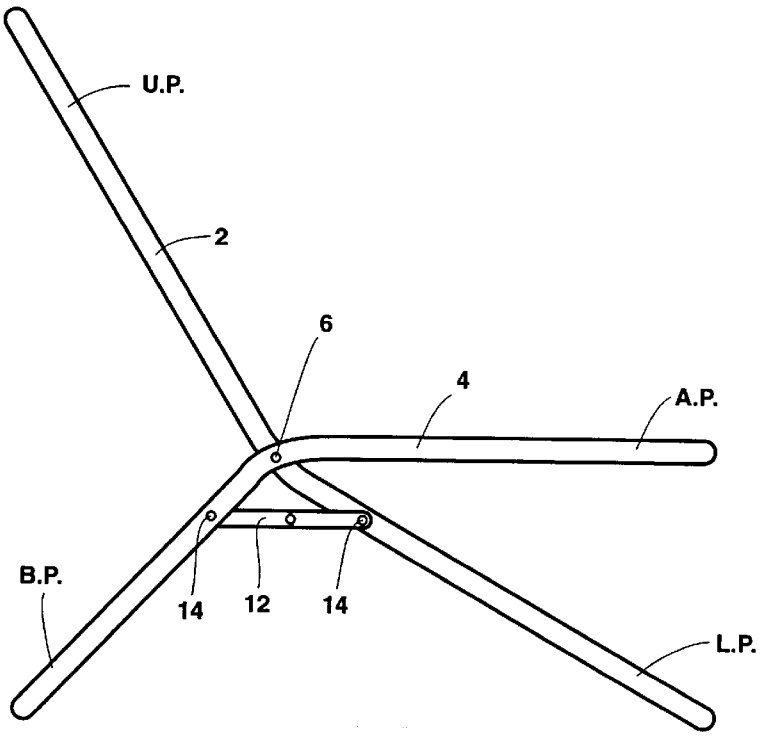
FIG. 9 is a side view of a typical embodiment of the present invention showing a side locking device.

FIG. 9 is a side view of a typical embodiment of the present invention showing a side locking device. The chair is made in a manner similar to that shown in FIGS. 1,2, and 3, but instead of the position securing chord 8 shown in FIG. 1A, the side locking device 12 is used on each side of the structure. This side locking device 12 is similar to those commonly used in lawn furniture. It is secured to the occupant supporting member 2 and the countersupporting member 4 with pivoting pins or rivets 14 as shown. Also, this can be folding in the center with a pivoting rivet right on the strap. Of course there are other ways of making side locking device that are known to those skilled in the art. Some other types of side locking devices or braces are hinges, knife hinges, locking hinges, locking slides, straps, catches, stays, braces, stops, flaps, brackets, and hasps. A chair frame such as this could be made using occupant supporting members like those shown in FIGS. 5A, 5B, 5E, 5F and 5G.

Figure 10:
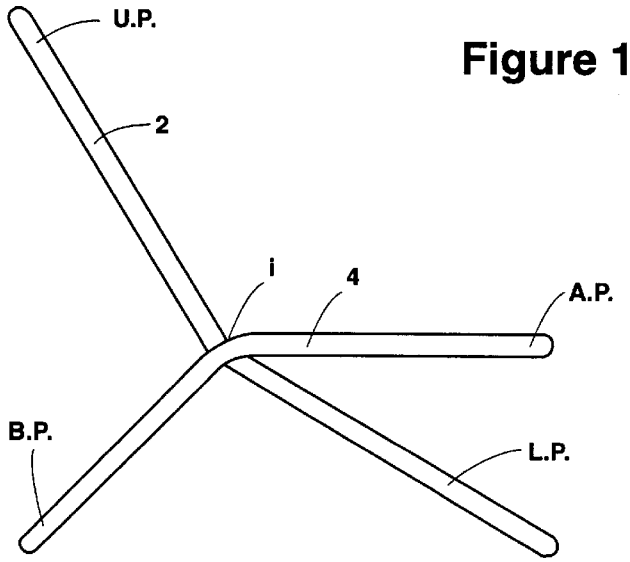
FIG. 10 is a side view of a typical embodiment showing the occupant supporting member and countersupporting member interlocking at the point of intersection.

FIG. 10 is a side view of a typical embodiment showing the occupant supporting member 2 and countersupporting member 4 interlocking at the point of intersection i. The advantage of this embodiment is that it eliminates the position securing chord 8 shown in FIG. 1A or the side locking device 12 shown in FIG. 9, giving the chair a cleaner look. This interlocking system i can be made in a number of ways. Probably the simplest way would be on a wooden model where the countersupporting member 4 is notched into the occupant supporting member 2 at the point of intersection i. Of course the opposite is also possible, or both the countersupporting member 4 and the occupant supporting member 2 could be notched in. These are notched woodworking type joinery methods using principles similar to those used in a cross lap joint. It might also be advisable to have a dowel, pin, or screw between the occupant supporting member and countersupporting member at the joint to make the joint stronger. The notching could be such that the chair could be fixed and not foldable, or notched in a manner that would enable it to be foldable if a pivoting pin were used at the point of intersection i. Other ways of making a frame that interlocks at the point of intersection would be to use a locking rotary hinge at the point of intersection i that works using some of the same principles as a door knob—it turns a certain distance before it hits a point where it will not turn anymore. On a tubular metal frame, the countersupporting member 4 and the occupant supporting member 2 could be welded at the point of intersection. Other methods of joining the occupant supporting member 2 to the countersupporting member 4 using an interlocking system i would be known to those skilled in the art and would include using a pivoting mechanism that is interlocking enabling the frame to be opened to the useable position and locking in place at the point of the interlocking mechanism i, and wherein the interlocking mechanism is selected from the group including ratchet type mechanisms, hole and pin locking mechanisms, key way and key interlocking mechanisms, flat spot and stop mechanisms, and variations thereof.

Figure 11:
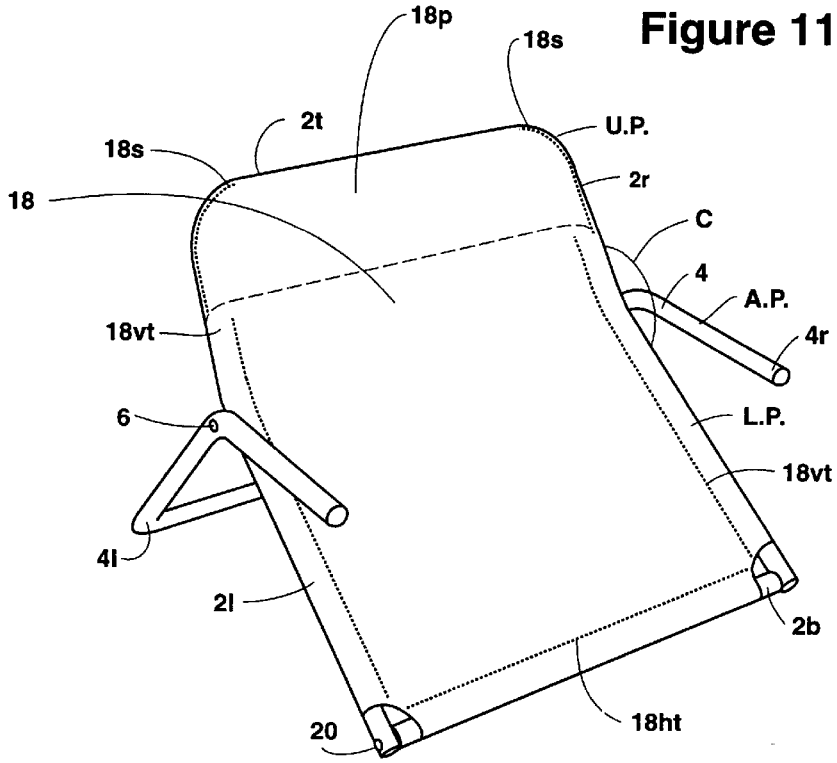
FIG. 11 is an isometric view of a leisure chair structure similar to the one shown in FIG. 1B, but with a shorter occupant supporting member.

FIG. 11 is an isometric view of a leisure chair structure similar to the one shown in FIG. 1B, but with a shorter occupant supporting member, and in particular the upper portion U.P. is shorter. The advantage of this type chair is that it is more compact, and for many people it is not essential to have a chair that supports the user's head and upper shoulders. This is made in generally the same manner as the structure shown in FIG. 1B, except the frame and support sheet are made shorter. In a preferred embodiment of this chair the occupant supporting member 2 is between about 18" and 20". And certainly it is possible to make it taller than this. Also the armrest portion A.P. can be made shorter.

FIG. 12 is an isometric view of a frame similar to those shown in FIGS. 1, 2, 3, and 10 shown upholstered in a typical fashion with cushions and other upholstery elements in a manner that might be suitable for a formal interior leisure chair.

The frame shown in FIG. 12 could be made of wood, laminated wood, bentwood, rectangular metal or plastic tubing, resin, or another appropriate material. In the drawing, the occupant supporting member 2 is seen with the top 2*t* and the left side 21, and also noted is the upper portion U.P. and the lower portion L.P. The occupant supporting member 2 is attached to the countersupporting member 4 in a manner similar to that shown in FIG. 1A except that the pivoting pin 6 shown in FIG. 1A is concealed for cosmetic reasons. The occupant supporting member 2 also has a support sheet made of canvas, webbing, wood, springs, wires, or other materials that can form a generally flat support structure to hold the main backrest cushion 12 in the proper position and is capable of properly supporting an occupant leaning against the backrest cushion 12. The main backrest cushion 12 might have an internal lumbar support as described in my previous applications. There is a seat cushion 14 attached to the lowest part of the occupant supporting member 2 with straps or another upholstery means. The seat cushion 14 can be attached by stapling straps or part of the upholstery to the lowest part of the occupant supporting member 2, or by sewing straps or part of the seat upholstery to a fabric support sheet as described under FIG. 1B. Also there is a head cushion 16 for providing comfort to the occupant under his or her neck. The head cushion 16 is shown strapped around the main cushion 12 with straps on the sides, which could be joined in the rear of the main cushion with a tri-glide or similar buckle type device. Also, the head cushion 16 could also be attached with straps from near the top 2*t* of the leisure chair. Certainly other methods are known and used in the upholstered chair industry which would be appropriate as well. The countersupporting member 4 is shown with the right side 4*r* and the left side 41 which are connected by a base portion 4*b*. If the frame is made of wood or wood like products, the base portion 4*b* can be connected to the sides 41 and 4*r* using mortise and tenons, or other woodworking joinery methods that should be known to those skilled in the art. Of course the base portion 4*b* can also be attached using lap joints and screws. If other materials are used, the base portion 4*b* can be joined to the sides using techniques known to those skilled in the art dealing with other materials such as welding etc. The armrest portion A.P. can be cushioned if desired, or can be left alone since it is fairly wide as shown. The base portion B.P. of the countersupporting member is shown slightly curved primarily for aesthetic reasons, while the armrest portion A.P. is shown straight.

FIG. 13 is an isometric view of a typical embodiment of a frame shown in FIG. 7 made of tubular metal in a manner similar to the structure shown in FIGS. 1, 2, and 3 but shown as it might be completed with a seat cushion 14, a head pillow 16, and pads 4*a* on the armrests. This type of chair might be ideal for casual or outdoor use. In the drawing, 4 is the countersupporting member, 2 is the occupant supporting member, there is a support sheet 18 made of canvas or another fabric stretched over the occupant supporting member 2 that will support the back, shoulders, neck and head of an occupant, a seat cushion 12 is attached to the bottom portion 2*b* of the occupant supporting member 2 with straps or another upholstery means, a head pillow 16 is attached to the upper portion U.P. of the occupant supporting member 2 using straps and something like tri-glides or a similar strap fastening product. Also shown is an optional armrest pad 4*a* that is attached to the armrest portion A.P. of the countersupporting member 4 to cushion the armrest or to distribute the pressure of an occupants arm on the armrest portion A.P. This armrest pad 4*a* can be made of wood, plastic, an upholstered cushion, or another suitable material.

Figure 14:
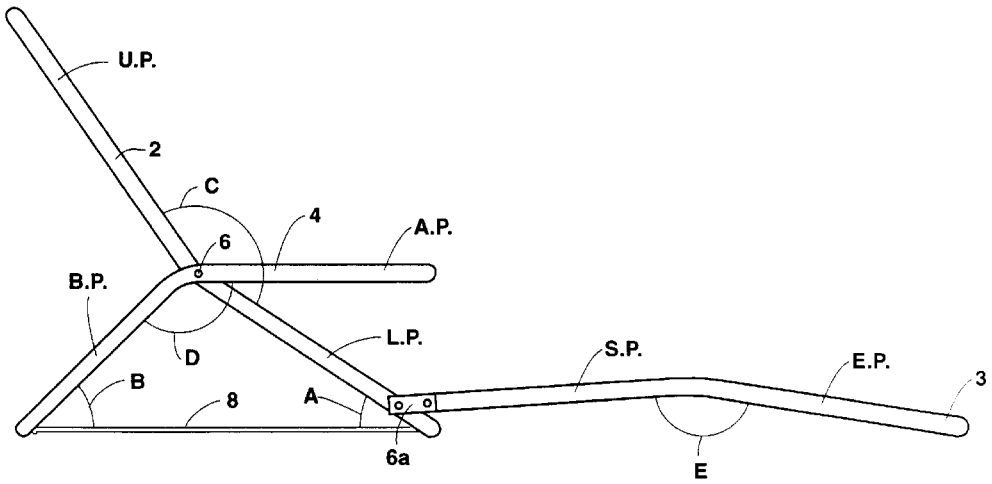
FIG. 14 is a side view of a structure similar to the one shown in FIGS. 1, 2 and 3, but with a seat and legrest member attached.

FIG. 14 is a side view of a structure similar to the one shown in FIGS. 1, 2 and 3, but with a seat and legrest member 3 attached. In the drawing, the seat and legrest member 3 is approximately the same shape and size as the occupant supporting member 2 and has a similar support sheet on it. The seat and legrest member 3 is attached to the occupant supporting member 2 with a pivoting mechanism 6*a* which could be similar to the pivoting mechanisms used on folding tubular chairs, cots and similar devices which enable tubes in the same plane to pivot, as opposed to the type of pivoting hinge shown in the drawing as 6 which is a side by side type of pivoting joint. The seat and legrest member 3 has a seat portion S.P. and an end portion E.P., and between the seat portion S.P. and end portion E.P. there is a bend forming an obtuse angle E which is fairly close to the obtuse angle bend C. The purpose of the seat and legrest member 3 is to support the legs of an occupant in a very comfortable manner, and yet be foldable in a manner that is about the same size as a leisure chair with a seat cushion such as in FIG. 13.

Figure 15B:
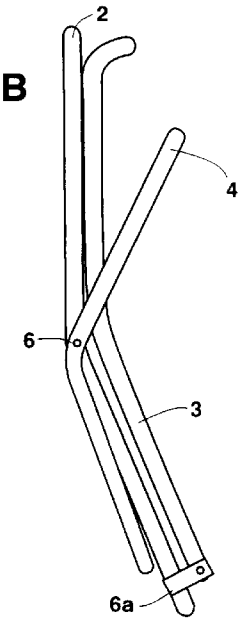
FIG. 15B is a side view of the leisure chair structure shown in FIG. 15A, but shown as it would look folded up.
Figure 15A:
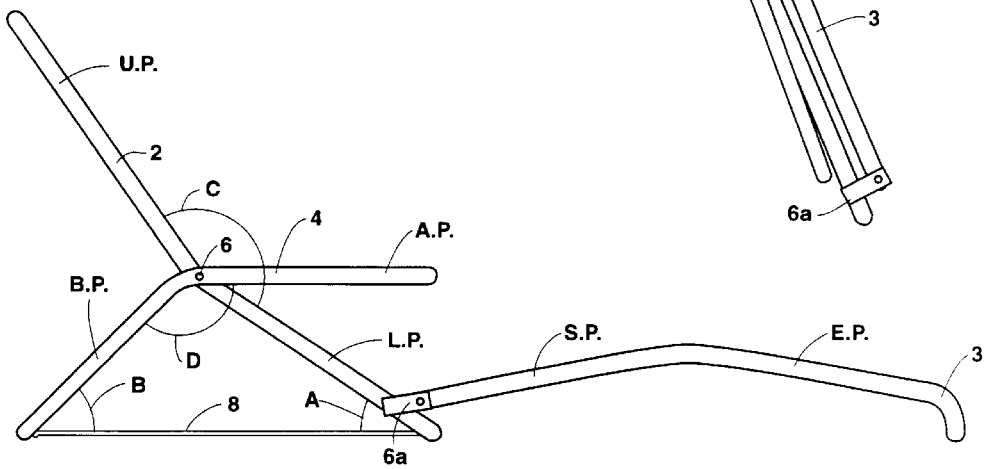
FIG. 15A is a side view of a leisure chair structure similar to the one shown in FIGS. 7 and 13, but with a seat and legrest member attached.

FIG. 15A is a side view of a leisure chair structure similar to the one shown in FIGS. 7 and 13, but with a seat and legrest member 3 attached. The seat and legrest member 3 is basically the same as described for FIG. 14, but it is in a somewhat different shape in that it is contoured more than having just a bend toward the middle, and at the end of the end portion E.P. the tube is bent at about a right angle to raise the seat and legrest member 3 a bit.

FIG. 15B is a side view of the leisure chair structure shown in FIG. 15A, but shown as it would look folded up. For storage or shipping, a number of such structures could be stacked together. This is folded in basically the same manner as FIG. 3.

CONCLUSIONS RAMIFICATIONS AND SCOPE OF THE INVENTION

Thus the reader will that this invention can be used for casual use such as for a beach or a recreation room, or can be used as a serious chair for a sophisticated home or apartment. Also there are many kinds of materials that can be used to make the frame including wood, bent wood, glue laminated wood, plywood, fiberglass, resin, steel, aluminum, and other materials that can be fairly strong while being long and thin. The frame can be made of tubular materials of various shapes including round, square, elliptical, etcetera, as well angled metal, u-shaped materials, plastic, vinyl, and other materials known or to be known to those skilled in the art relating to this invention. And it may be preferable to make the frame of different materials, such as making the occupant supporting member (which could be covered with fabric) out of tubular metal, while the countersupporting member could be made out of wood for aesthetic reasons. Additionally, all of the above can be made of various diameters or thicknesses.

The occupant supporting member can be made of one piece or more than one piece. And likewise, the countersupporting member and armrest portion can be made of one piece or more than one piece. The occupant supporting member can be attached to the countersupporting member with or without being pivoting. For example, the materials can be welded or in the case of wood notched.

The cross members 2*t*, 2*m*, and 2*b* cross members can be contoured, and especially in a concave manner to make the support sheet 18 somewhat concave in a side to side manner resulting the occupant supporting member 2 being more in the shape of an occupant. Also the cross member 4*b* can be contoured for aesthetic purposes. And, armrests can have additional elements added such as wood, or padding, or additional metal to make them wider, etc.

The frame can be made of different sizes to accommodate people of different sizes as well as smaller for use by children. Also, the frame can be made wider for comfort or for multiple users in a manner similar to a love seat—or narrower for compactness.

The concepts shown on various embodiments are interchangeable, for example, the structure shown in FIG. 13 as well as all of the other structures can be made with main cushions over the structure as shown in FIG. 12. Also, FIG. 11 could be made with an occupant supporting member that is contoured like the one shown in FIG. 13. The side locking device shown in FIG. 9 can be used with a contoured structure such as on FIG. 8. Any of the occupant supporting members 2 described can be used with any of the countersupporting members 4 described, and any of the attachment means shown with any structures are interchangeable with all of the countersupporting members 4 and occupant supporting members 2 except where exceptions have been noted. Additionally though FIG. 2 and other FIGS. have shown some of the shapes and angles of currently preferred embodiments of this invention, the angles A, B, C, and D and their equivalents shown or not shown in all of the embodiments, can be made in the following ranges—angle A can be from close to 0 degrees to almost 90 degrees, angle B can be from about ten degrees to about 90 degrees, angle C can be from about 150 degrees to about 180 degrees and angle D can be from about 90 degrees to about 180 degrees. Also, it is not necessary that the armrest portion A.P. of the countersupporting member be generally horizontal as shown in FIG. 2 and others FIGS., but can be angled a bit above or below the horizontal plane.

Thus the scope of the invention should be determined by the appended claims and their legal equivalents, rather than by the examples given.

I claim:

1. A structure for a leisure chair comprising:

(a) an occupant supporting member having two symmetrical sides, an upper cross member, a lower cross member and a support sheet means, wherein the means is selected from a group consisting of webbing, a plurality of slats, springs, wires, a sheet of fabric, plywood, molded resin, and other products that can comprise a sheet, extending substantially from the upper cross member to the lower cross member, said support sheet being generally taut between the upper and lower cross members and extending in generally the same plane as that defined by the symmetrical sides, said occupant supporting member having a lower portion and an upper portion, said lower portion further being oriented to form an acute angle relative to a horizontal plane such as a floor or ground surface with said lower cross member being adjacent and parallel to said horizontal plane;

(b) a countersupporting member having two symmetrical sides and at least one base cross member, said countersupporting member having a base portion and an armrest portion which are integral and continuous, said base portion of the countersupporting member being oriented at an acute angle opposite the occupant supporting member acute angle such that the countersupporting member intersects with the occupant supporting member at intersection points between the upper portion and lower portion of the occupant supporting member in such a manner that a generally triangular shape is formed with the horizontal plane being a base, the lower portion of the backrest member being one side, and the base portion of the countersupporting member below the occupant supporting member being another side, and wherein the armrest portion of the countersupporting member extends in a generally horizontal manner beyond the intersection points for the provision of armrests for the leisure chair; and (c) an attachment means interconnecting each side of the countersupporting member to the occupant supporting member at the intersection points.

2. The structure of claim 1 wherein the occupant supporting member further includes at least one cross member between the upper cross member and lower cross member mounted between the two sides of the occupant supporting member.

3. The structure of claim 1 wherein the attachment means is comprised of a pivoting mechanism.

4. The pivoting mechanism of claim 3 wherein there is also a bracing means located below the pivoting mechanism attached to each of the sides of the occupant supporting member and also attached to the sides of the base frame, and wherein the bracing means is selected from the group including hinges, knife hinges, locking hinges, locking slides, straps, catches, stays, braces, stops, flaps, brackets, and hasps.

5. The pivoting mechanism of claim 3 wherein there is also at least one means interconnecting the lower cross member of the occupant supporting member with the base cross member of the base frame, wherein the means is selected from the group consisting of belts, straps, chords, rods, cables, wires, bars, tubes, chains, rope, webbing, and other generally long thin materials which can fasten things together with, and said means is secured to the lower cross member of the occupant supporting member and to the base cross member of the countersupporting frame.

6. The pivoting mechanism of claim 3 where there is also at least one means interconnecting the upper cross member of the occupant supporting member with the base cross member of the countersupporting frame, wherein the means is selected from the group consisting of belts, straps, chords, rods, cables, wires, bars, tubes, chains, rope, webbing, and other generally long thin materials which can fasten things together with, and said means is secured to the upper cross member of the occupant supporting member and to the base cross member of the countersupporting frame.

7. The pivoting mechanism of claim 3 wherein the pivoting mechanism is interlocking enabling the frame to be opened to the useable position and locking in place at the point of the interlocking mechanism, and wherein the interlocking mechanism is selected from the group including ratchet type mechanisms, hole and pin locking mechanisms, key way and key interlocking mechanisms, flat spot and stop mechanisms, and variations thereof.

8. The structure of claim 1 wherein the attachment means at the points of intersection is a notched woodworking type joinery method using principles similar to those used in a cross lap joint.

9. The occupant supporting member of claim 1 wherein the support sheet is integral and continuous with the upper cross member, the lower cross member and the sides as in with a sheet of plywood or other rigid sheet material.

10. The occupant supporting member of claim 1 further including a bend on each of the symmetrical sides such that the upper portion is oriented at a higher angle than the lower portion relative to a horizontal plane.

11. The occupant supporting member of claim 1 wherein the lower portion of the sides have a convex contour to support the occupant's lumbar region in a relatively natural lordotic curve.

12. The occupant supporting member of claim 1 wherein the sides of the frame are contoured in a manner to provide that the average incline of the upper portion of the frame is at a higher angle than the average incline of the lower portion.

13. The leisure chair structure of claim 1, wherein the base portion of the countersupporting member bears directly on the horizontal plane.

14. The leisure chair structure of claim 1 wherein an upholstery system including a cushion is secured to the support sheet.

15. The leisure chair structure of claim 1 wherein a seat cushion is attached near the lower cross member of the occupant supporting member.

16. The leisure chair structure of claim 1 wherein the occupant supporting member has an additional reinforcing material stretched between the sides of the lower portion for the purpose of supporting an occupants lumbar region in a relatively natural lordotic curve, and wherein the reinforcing material is selected from a group consisting of webbing, elastic webbing, canvas, cloth, fabric, flexible plastic, vinyl, belts, straps, strings, and other thin relatively thin flat flexible materials.

17. The leisure chair structure of claim 1 wherein a seat and legrest structure of a shape generally similar to the occupant supporting member is attached to the lower portion of the occupant supporting member.

18. A structure for a leisure chair comprising:

(a) a generally rectangular occupant supporting member comprised of two symmetrical sides and upper and lower cross members, and having a support sheet means substantially filling the area of the rectangular shape of the occupant supporting member, wherein the support sheet means is selected from a group consisting of webbing, a plurality of slats, springs, wires, a sheet of fabric, plywood, molded resin, and other products that can comprise a sheet, said two symmetrical sides defining a left side and a right side, said support sheet extending substantially from the upper cross member to the lower cross member and being generally taut such that it extends in generally the same plane as that defined by the left and right sides of the occupant supporting member, said rectangular occupant supporting member having an upper portion and a lower portion, said lower port further being oriented to form an acute angle relative to a horizontal plane such as a floor or ground surface with said lower cross member being adjacent and parallel to said horizontal plane;

(b) a generally U-shaped countersupporting member having two symmetrical sides and at least one base cross member, said countersupporting member having a base portion and an armrest portion which are integral and continuous, said base portion of the countersupporting member being oriented at an acute angle opposite the occupant supporting member acute angle such that the countersupporting member intersects with the occupant supporting member at intersection points between the upper portion and lower portion of the occupant supporting member in such a manner that a generally triangular shape is formed with the horizontal plane being a base, the lower portion of the backrest member being one side, and the base portion of the countersupporting member below the occupant supporting member being another side, and wherein the armrest portion of the countersupporting member extends in a generally horizontal manner beyond the intersection points for the provision of armrests for the leisure chair; and (c) an attachment means interconnecting each side of the countersupporting member to the occupant supporting member at the intersection points.

19. The structure of claim 18 wherein the occupant supporting member is contoured in a manner to provide that the average incline of the upper portion of the frame is at a higher angle than the average incline of the lower portion and the lower portion has a convex contour to support the occupant's lumbar region in a relatively natural lordotic curve.

20. The structure of claim 18 wherein the occupant supporting member has a bend between the upper and lower portion such that the upper portion is oriented at a higher angle than the lower portion.

21. The structure of claim 18 further including at least one means of interconnection between the base portion of the countersupporting member and the lower portion of the occupant supporting member for securing the structure in an open position, wherein the means is located below the points of intersection, and wherein the means is selected from the group comprising knife hinges, locking hinges, locking slides, straps, catches, stays, braces, stops, flaps, brackets, hasps, belts, straps, chords, rods, cables, wires, bars, tubes, chains, rope, webbing, and other generally long thin materials which can fasten things together with.

22. A structure for a leisure chair consisting of:

(a) an occupant supporting member having a frame comprised of two symmetrical side and upper and lower cross members, and support sheet means, wherein the a support sheet means is selected from a group consisting of webbing, a plurality of slats, springs, wires, a sheet of fabric, plywood, molded resin, and other products that can comprise a sheet, wherein the combination frame and support sheet means define a generally rectangular shaped occupant supporting member, two symmetrical sides defining a left side and a right side, said support sheet extending substantially from the upper cross member to the lower cross member and being generally taut such that it extends in generally the same plane as that defined by the left and right sides of the occupant supporting member, said rectangular occupant supporting member having an upper portion and a lower portion, said lower portion further being oriented to form an acute angle relative to a horizontal plane such as a floor or ground surface with said lower cross member being adjacent and parallel to said horizontal plane;

(b) a countersupporting member having two symmetrical sides and at least one base cross member, said countersupporting member having a base portion and an armrest portion which are integral and continuous, said base portion of the countersupporting member being oriented at an acute angle opposite the occupant supporting member acute angle such that the countersupporting member intersects with the occupant supporting member at intersection points between the upper portion and lower portion of the occupant supporting member in such a manner that a generally triangular shape is formed with the horizontal plane being a base, the lower portion of the backrest member being one side, and the base portion of the countersupporting member below the occupant supporting member being another side, and wherein the armrest portion of the countersupporting member extends in a generally horizontal manner beyond the intersection points for the provision of armrests for the leisure chair; and (c) an attachment means interconnecting each side of the countersupporting member to the occupant supporting member at the intersection points.

* * * * *